US005505640A

United States Patent [19]

Angulo

[11] Patent Number: 5,505,640

[45] Date of Patent: Apr. 9, 1996

[54] PROPULSION SYSTEM FOR SHIPS

[76] Inventor: Francisco M. Angulo, Vega 3., 47004 Valladolid, Spain

[21] Appl. No.: 405,998

[22] Filed: Mar. 17, 1995

[30] Foreign Application Priority Data

May 16, 1994 [ES] Spain ..... 9401057

[51] Int. Cl.[6] ..... B63H 11/117

[52] U.S. Cl. ..... 440/43; 440/47

[58] Field of Search ..... 114/151, 153; 440/38, 43, 47; 60/221, 222

[56] References Cited

U.S. PATENT DOCUMENTS 2,730,065 1/1956 Piper ..... 440/38
3,759,213 9/1973 Quady ..... 440/38
3,918,389 11/1975 Shima ..... 440/38
3,961,591 6/1976 Fuller ..... 440/43

*Primary Examiner*—Stephen Avila
*Attorney, Agent, or Firm*—Pollock, Vande Sande & Priddy

[57] ABSTRACT

A propulsion system for a ship is capable of launching a mass of water with a high hydraulic performance. The system comprises a water intake conduit for providing a passage for aspirated water which is then propelled by blades attached to a rotor which continuously rotates inside a chamber. A rotary valve obturator is located adjacent the rotor. The rotary valve obturator is synchronized with the rotor by continuously rotating in a direction counter to the rotor for separating the intake water from the discharged water. The aspirated and propelled water inside the chamber is then discharged through a water discharge conduit which causes the ship to move.

3 Claims, 2 Drawing Sheets

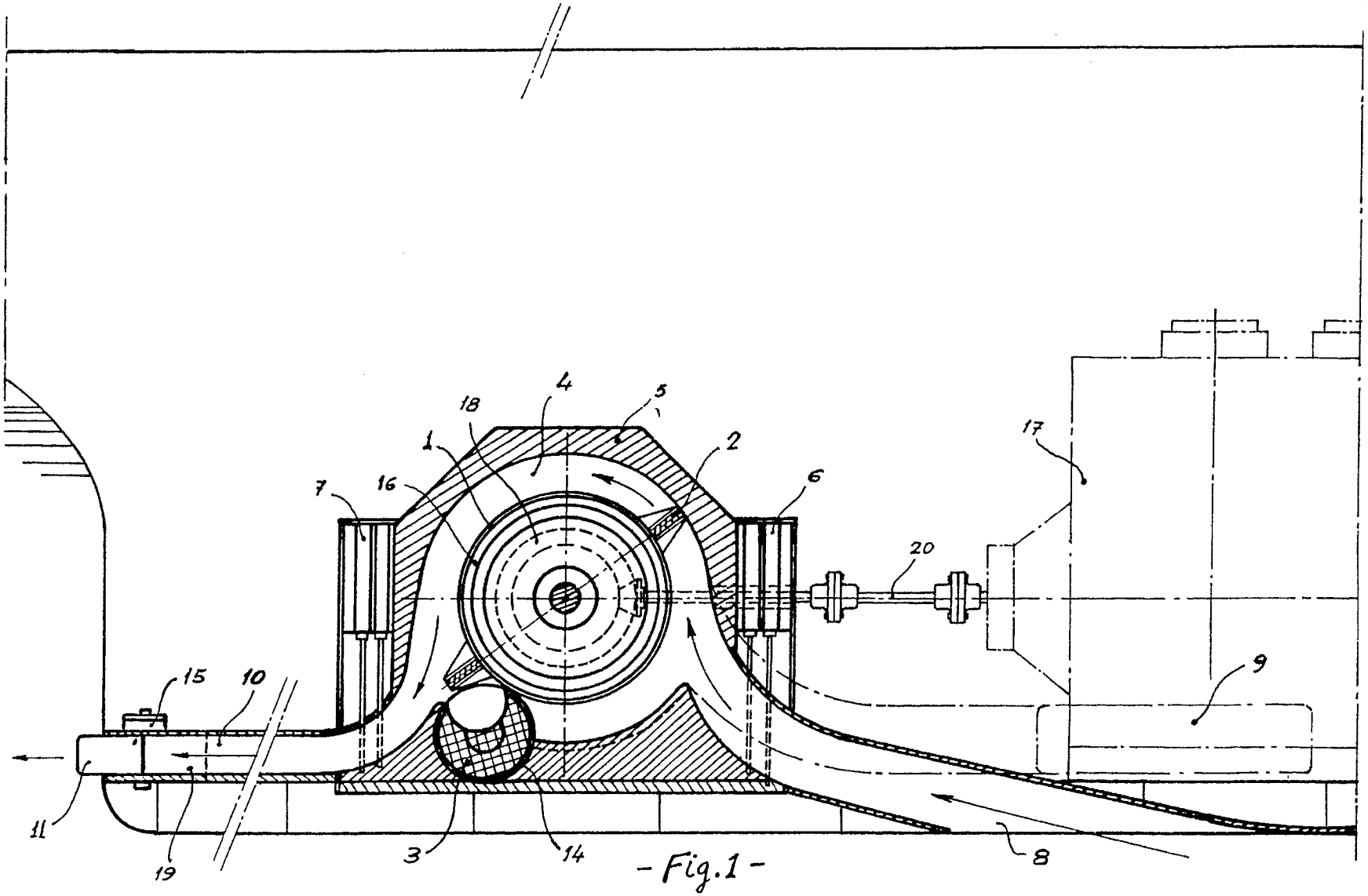
- Fig. 1 -

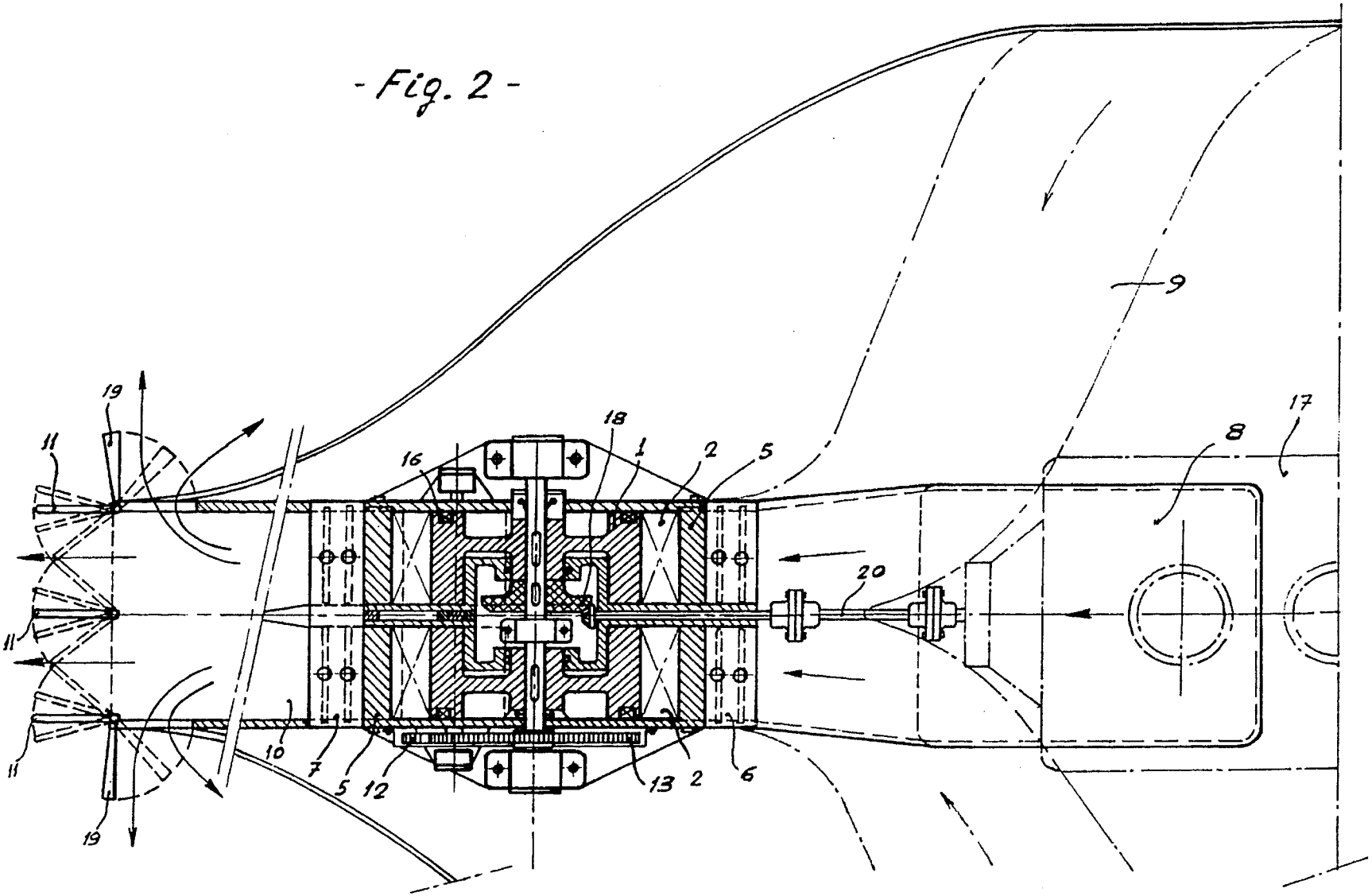
- Fig. 2 -

PROPULSION SYSTEM FOR SHIPS

The invention presented, refers to a hydraulic system capable of launching a mass of water with high hydraulic performance and at velocity which is deemed to be most ideally suited to the type of ship that has to be moved.

This works in relation to Newton's third law in that, the action of this mass of water with a determined velocity, will provoke an equal and opposite reaction in moving the ship having the mass of water expelled through an aperture in the stern.

Naturally, for this hydraulic propulsion system to be commercially viable, it must have superior overall performance than that of the best of conventional propellers (helix), in use today. This is especially true in the merchant navy, where its installation and use can be justified by being cheaper and more frugal in its use of fuel, making maritime transport more economic and more ecological. In the exit aperture, there are also a number of vertical plates, with variable orientation, which act upon the flow of water acting as a rudder.

On the other hand, due to an installation inside the hull, this new propulsion system is much safer than the conventional propeller, when maneuvering or mooring in port. Fishing vessels would become safer due to complete elimination of the risk of fouling their nets in the propeller.

Navy warships would also benefit from greater security of not losing the propeller, a potential weakspot in its defences.

This new propulsion hydraulic turbine, which is installed inside the ship's hull, either in the center or the stern, that is to say in the engine room, is turned by a motor, be it diesel, electric, or steam, and spins at much higher revolutions than the conventional propeller, used in the merchant navy today. Therefore the size, weight and cost of motors needed to work the propulsion turbine would be far smaller.

Another advantage of the new propulsion system is that, it does not suffer from the waste of the mass of water at the periphery of the propeller, which is lost laterally when in use. The inactive faces of a conventional propeller also offer a resistance during their advance, which eliminates the suction coefficient, and reduce still further its performance to only 54% efficiency.

Another important advantage is that with the new propulsion system, the propeller transmission shaft and all of its supports which absorb at least 8% of the output, can effectively be eliminated. The exit of the propeller shaft can also be eliminated, which currently has to absorb huge vertical forces in heavy seas. The shocks transmitted by wave action to this part of the hull reverberate through the propeller, its output bearings, transmission shaft, and all of its supports absorbing at least another 4% of the power output. The friction clutch absorbing this can therefore also be eliminated.

The cost, weight and volume of space taken up by all the aforementioned parts can all be eliminated, saving a lot of energy in the process, which all means that the installation of the new propulsion system would be much cheaper and more commercially viable. Seeing that this new hydraulic turbine for the propulsion of water has a higher mechanical and hydraulic performance than the conventional propeller means that the overall performance gained by installing this new turbine would be far superior to that of the conventional propeller, while at the same time being safer for port maneuvers.

On the other hand, where a ship is at half load or empty, the efficiency of the new propulsion system is even higher in comparison to the conventional propeller having part of it blades out of the water.

This new propulsion system with volumetric performance being about 80%, is far superior to other apparatuses, such as centrifugal pumps which were installed inside the hull and worked by steam or diesel motors, whose volumetric performance was in the order of 35% and though they also permitted the elimination of the transmission shaft, supports, etc., the overall performance was inferior to that of the conventional propeller.

Other registered solutions are known such as Pat. No. 538,992 dated Dec. 21, 1984 and entitled "Impulsion system for navigation".

This consists of the installation of a centrifugal pump situated inside the center of the hull of the ship, connected to the bow by means of a straight conduit for the expulsion of water. Wrapped around this, on the exterior of the stern is also to be found a further cylindrical conduit leaving an intermediate cavity through which passes water absorbed by the Venturi effect due to exiting water.

In this solution, it has to be taken into account that:

First, a centrifugal pump only has an overall performance of 35%, this being quite inferior to the conventional propeller which is of 54%.

Second, the straight line conduits for water intake and exit are very long and would incur significant losses of energy, which would further reduce the performance of the whole system. Moreover, when navigating in heavy seas, the bow is constantly lifting clear of the water, the effect of which, is that water fails to reach the centrifugal pump adequately and further reduces its performance.

Third, the Venturi effect in the stern causes another mass of water to move in the opposite direction to that of the ship, which partly helps its forward motion, but on the other hand, the cylindrical conduit surrounding the exit aperture of water from the centrifugal pump produces a passive resistance by its forward motion with the ship, which almost completely eliminates the Venturi effect, and thus the performance remains inferior to that of the conventional propeller.

The water conduits which run the entire length of the ship also occupy considerable space thus reducing the load capacity.

Another registered solution is according to Pat. No. P8,902,357 dated Apr. 7, 1989 and entitled "Propulsion system for boats". This consists of the installation of four "wheels" with straight or curved paddles, mounted on the sides of the bow and stern, each with an exterior blade to guide the propelled water. This has the disadvantage that when each of these wheels turns, there is no form of valve to separate incoming and outgoing water, and so forms a "closed circuit" of water around each wheel producing lower volumetric performance and efficiency. The exterior blades and the opposing faces of the paddles also produce a resistance to the forward motion of the ship and therefore it can easily be appreciated why the overall performance of this system is inferior to the conventional propeller.

It would also be necessary to construct two engine rooms to operate each pair of wheels, and if each wheel with its paddles were to be operated by an electric motor as FIG. 1 appears to infer, overall transmission with four electric motors, as is already known has a lower performance than that of a single equivalent motor used to drive a single propulsion unit, which means that summarizing the disadvantages of this system of propulsion, it is clear that its performance is vastly inferior to that of the conventional propeller.

It also has another important disadvantage by virtue of having two wheels to port and two wheels to starboard, leading to dangerous port maneuverers, such as the risk of damaging the paddle wheels against the quayside or the risk to human life where small boats are close to the ships hull.

Another registered solution is that described in Pat. No. P550,948 dated Jan. 16, 1986 and entitled "Paddle wheel for the propulsion of medium and large shipping" according to this patent, the paddle wheel would be situated in the keel at the stern of the hull, and that the blades of the rotor would protrude approximately 50 cm below the base of the keel. Positioning the paddle wheel thus, without any valve or barrier between intake and exit of water, causes the paddle blades to rise from a position below the keel, through a cavity in the hull causing a vacuum which lifts the water and produces a closed circuit flow of water inside the cavity of the hull. The resultant mass of water propelled to provoke motion of the ship is therefore very small and the greater proportion of energy available is used in moving water in closed circuit. This does nothing to help the motion of the ship and as such its overall performance is also less than that of the conventional propeller. If the paddles are rotating at high speed, this will provoke a vacuum with even worse results.

Another solution is described in the Utility Model No. U120747 dated Mar. 31, 1966 and entitled "Paddle propulsion for navigation". This consists of a number of paddles spinning in two directions, one paddle turning at ninety degrees of orientation in relation to its opposing paddles, once passed an active point, and also turning on an axis. These gyrating movements cause a large amount of turbulence in the mass of water provoking a large amount of vibration on the paddle shafts which would then be transmitted to the hull of the ship with all the associated inconvenience.

If it is taken into account that the active travel of each paddle blade reaches approximately only 90 degrees of travel, then in approximately 270 degrees of each rotation, each paddle blade is not only inactive, but produces a resistance, meaning that these blades work in an inferior manner and with lower performance than those of the conventional propeller.

To enable a clearer understanding of the characteristics of this invention, there follows a detailed description of all its component parts also shown in the accompanying drawings, and is provided to guide but not limit its interpretation.

FIG. 1 shows a vertical cross section of the new propulsion system for ships, installed in the stern engine room, demonstrating the intake of water through the double base or the sides of the hull depending upon the application required, and the expulsion through a conduit towards the stern. The water filters can also be seen and are mechanized so that they can be lowered into position for maneuverers in a port or river.

In FIG. 2, a horizontal cross section shows more clearly the action of the variable orientation plates in the stream of expelled water, acting as rudders.

In the above mentioned drawings, the reference numbers correspond to the following components:

1. Propulsion rotor.
2. Rotor blades which suck and propel the water.
3. Rotary valve (obturator) which divides the aspiration zone from the expulsion zone.
4. Circular chamber with rectangular or other section.
5. Outer casing, within which rotates the propulsion rotor (1) and the rotary valve-obturator (3).
6. Double filter for the intake of water when in forward motion.
7. Double filter for the intake of water when in reverse.
8. Intake aperture and conduit when in forward motion.
9. Possible lateral intake apertures and conduits when in forward motion.
10. Exit conduit for expelled water when in forward motion.
11. Variable orientation vertical plates in the stream of expelled water which act as inboard rudders.
12. Exterior gearing for the shaft of rotary valve-obturator.
13. Exterior gearing for the rotor shaft synchronized with the rotary valve.
14. Elasticated sleeve over the surface of the rotary valve to pick up particles floating in suspension in the water.
15. Mechanized rudder pivots.
16. Hydraulic locking rings on the sides of the rotor to provide good hydraulic sealing.
17. Power unit for propulsion unit.
18. Reductor gear, connected with the transmission shaft (20).
19. Variable orientation vertical plates, for the lateral movements of the ship, and for the back speed for the maneuverers of the ship in port.
20. Transmission power shaft.

As can be seen in the figures referred to earlier, the propulsion rotor (1), which has two blades (2) or more if necessary, of rectangular section, squared or other, is moved by a motor which makes it turn at a specified speed depending upon the application required. These blades (2) produce a vacuum from the rearward face during their forward motion, thus sucking up water through an inlet conduit (8), situated in the double base of the ship or else through two lateral conduits (9), depending upon the application.

Equally, the other side of the blade (2), pushes the water formerly sucked into the circular chamber (4), by the anterior blade, and accelerates it towards the exit conduit (10), acting like a continuous piston, tracing a curved path so that the resulting jet of water exits from the stern provoking a reaction which makes the ship advance.

The rotary valve-obturator (3), serves to divide the zones of aspiration (intake), and expulsion (exit), and to avoid a closed circuit of water around the rotor (1), which would considerably reduce its volumetric performance and efficiency. This rotary valve-obturator (3) contra-rotates to the main rotor (1), so that in the case of figure (1) where two blades exist, the rotary valve-obturator would rotate twice for every one revolution of the rotor, there being two gears (12) and (13) which would synchronize this movement from the rotor shaft (1).

On the other hand, in cases where more blades would improve the volumetric performance of the turbine, the rotary valve (3), would spin faster.

Depending upon its use, there remains a possibility of installing in the machine an additional rotary valve-obturator, not shown, situated near the inlet conduit, which would further increase the volumetric performance, but would also increase the cost of manufacture, although there may be cases in which this would be justifiable.

The grate (or other type depending on situation) water filters (6 and 7), serve to filter out any objects mixed with the intake water for example, while maneuvering in port, which could otherwise damage the surfaces of the rotor chamber (4), the rotor (1), or the rotary valve (3). These filters are duplicated so that one of each pair can always be in raised position and can be cleaned from inside the ship, although the ones in working position can easily be cleaned by reversing the direction of the rotor, for a short period, the filters can be kept in a raised position once out in open sea, their use being more important in port or polluted waterways.

Equally the rotary valve (3) wears a circular sleeve throughout all its length of elasticated material (14), capable of picking up any particles held in suspension in the water and is easy to clean or replace, therefore avoiding damage to the exterior surface of the rotor.

The vertical plates (11), situated in the exit aperture of the stern, serve to direct the stream of water exiting the hull, acting as a rudder to steer the ship. The plates orientation is controlled in a coordinated fashion directed from the bridge. The use of these inboard rudders eliminates the need for a conventional rudder situated behind the propeller.

A conventional rudder causes turbulence in the water exiting the propellers and is also subject to lateral forces on its surface from transverse ocean currents which make navigation difficult. Eliminating the conventional rudder would therefore ease navigation.

For ease of maneuverers in a port, when maneuvering to or from a quayside mooring, lateral water exit tubes connected to the propulsion system could be incorporated into the design fore and aft. This would provide a sideways jet of water provoking an opposite sideways movement in the ship. These tubes could then be closed once the maneuver is completed. In further interests of marine safety, in the unfortunate event of a ship running aground on an underwater obstacle such as a sand bank, there is a far greater possibility that it may "reverse off" the obstruction using the new propulsion system. This works in a similar way to that which has already been seen with landing craft using water jet propulsion, where not only is more thrust applied, but the jet actively clears the obstructive material away.

I claim:

1. A propulsion system for moving a ship, comprising:

a water intake conduit providing a passage for aspirated water;

a circular chamber connected to said water intake conduit;

a rotor with a pair of blades located in said circular chamber and continuously rotating at high velocity to create a vacuum in said circular chamber, whereby water is drawn into said circular chamber through said water intake conduit;

a water discharge conduit connected to said circular chamber and located opposite from said water intake conduit for expelling water from said circular chamber; and a rotary valve obturator located adjacent said rotor, said rotary valve obturator having a segment-shaped channel located partially along its circumference and rotating in a counter-direction with said rotor, rotations of said rotary valve obturator being synchronized with rotations of said rotor so that each blade of said pair of blades passes through said channel which closes immediately thereafter due to said rotations of said rotary valve obturator thereby creating two zones of water intake and expulsion, whereby said rotary valve obturator prevents formation of a closed circuit of water and produces a minimal loss of water with a maximum volumetric performance, said system acting as a continuous piston tracing a curved path producing a continuous expulsion of water through said water discharge conduit which, when directed aft, causes said ship to move forward.

2. The system according to claim 1, further comprising two intermeshing gear wheels situated outside said circular chamber, one of said gear wheels being connected to a shaft of said rotor and driven by a ship's engine, another of said gear wheels being connected to a shaft of said rotary valve obturator to synchronize its rotation with said rotor so that said rotary valve obturator rotates twice for every rotation of said rotor.

3. The system according to claim 1, further comprising variably orientatable plates at an end of said water discharge conduit for regulating a flow direction of expelled water, whereby said plates act as rudders to guide and maneuver said ship.

* * * * *